United States Patent [19]

Beard et al.

[11] Patent Number: 4,850,167

[45] Date of Patent: Jul. 25, 1989

[54] STRUCTURAL GLAZING SYSTEMS FOR SKYLIGHTS

[75] Inventors: Philip W. Beard, LeCompte; Cecil D. Hart, Alexandria, both of La.

[73] Assignee: Architectural Aluminum, Inc., Alexandria, La.

[21] Appl. No.: 153,324

[22] Filed: Feb. 8, 1988

[51] Int. Cl.[4] ..... E04D 7/18

[52] U.S. Cl. ..... 52/200; 52/14; 52/464

[58] Field of Search ..... 52/200, 13, 235, 397, 52/772, 468, 14, 464

[56] References Cited

U.S. PATENT DOCUMENTS

| | | | |
|---|---|---|---|
| 3,266,207 | 8/1966 | Birum | 52/235 |
| 3,321,880 | 5/1967 | Ferrell | 52/235 |
| 3,380,210 | 4/1968 | Neal | 52/235 |
| 3,394,526 | 7/1968 | Englebrecht | 52/772 |
| 3,443,350 | 5/1969 | Birum | 52/772 |
| 3,553,918 | 1/1971 | Dauson | 52/235 |
| 3,734,550 | 5/1973 | Vance | 52/235 |
| 3,785,104 | 1/1974 | Dailen | 52/235 |
| 3,858,375 | 1/1975 | Silvernail | 52/235 |
| 3,932,974 | 1/1976 | Wright | 52/468 |
| 4,070,806 | 1/1978 | Hubbard | 52/395 |
| 4,141,188 | 2/1979 | Sukolics | 52/395 |
| 4,270,332 | 6/1981 | Montrouil | 52/772 |
| 4,455,798 | 6/1984 | Tsakiris | 52/200 |
| 4,621,472 | 11/1986 | Kloke | 52/200 |
| 4,683,693 | 8/1987 | Rockar | 52/235 |

*Primary Examiner*—John E. Murtagh

*Attorney, Agent, or Firm*—John M. Harrison

[57] ABSTRACT

Structural glazing systems for skylights which are designed to facilitate installation, maintenance and replacement of skylight panels from inside a host structure. The internal fastening apparatus of the structural glazing systems include multiple, open-chamber carrier beams which are interconnected in a lattice or grid configuration and are each shaped to receive a pair of parallel, spaced bottom glazing strips for receiving the bottom edges of separate glass or plastic skylight panels. Companion exterior glazing caps each carry a pair of spaced top glazing strips for seating on the top edges of the skylight panels. The exterior glazing caps are shaped to facilitate bolting to the carrier beams and securing the glass or plastic skylight panels in position between the top and bottom glazing strips. A carrier beam closure is designed to removably close the open chamber of each hollow carrier beam and to facilitate concealment of, and access to, the multiple cap bolts which are used to bolt the carrier beams to the corresponding exterior glazing caps, respectively. A system of condensate gutters is provided on the carrier beams, which gutters meet at the points of intersection of the carrier beams to carry condensate away from the glass or plastic panels.

10 Claims, 4 Drawing Sheets

1
2
3
4
5
8
12
19
20
23
25
26
30
31
34
35
36
39
42

STRUCTURAL GLAZING SYSTEMS FOR SKYLIGHTS

BACKGROUND OF THE INVENTION

1. Field of the Invention

This invention relates to structural glazing systems for skylights in solaria, greenhouses, barrel vaults and like structures and more particularly, to skylight structural glazing systems having an internal fastening network which effectively eliminates the need for exterior fasteners, holes and slots normally used in conventional skylight mounting and support systems. The structural glazing systems of this invention include a bottom closure system for securing glass or plastic skylight panels between straight runs of the carrier beam supporting members and a side closure system for mounting the panels between carrier beam structural members extending over walls, heads, sills or jambs in a structure. Each of the bottom and side closure systems includes multiple, specially designed, open-chamber carrier beams which are each shaped to receive a pair of spaced, parallel carrier glazing strips for engaging the edges of the bottom surfaces of a pair of adjacent glass or plastic skylight panels to be mounted. Multiple companion exterior glazing caps, each of which includes a pair of spaced cap glazing strips for engaging the edges of the top surfaces of the glass or plastic skylight panels are also provided, for securing the skylight panels between the exterior glazing caps and the corresponding carrier beams by means of spaced cap bolts, which are inserted from the underside of the carrier beams through spaced openings provided therein, into the exterior glazing caps. A carrier beam closure is removably fastened to the bottom edges of some of the carrier beams and to the side edges of other carrier beams, to close the chamber, conceal the cap bolts and facilitate access to the cap bolts from the inside of the structure for removal of the skylaght panels without the necessity of traversing the roof of the structure.

Conventional skylight glazing systems for residential, commercial and other structures, such as fixed or movable, sloped or curved glazing in solaria, greenhouses and barrel vaults, in non-exclusive particular, are normally designed to facilitate access to the glass or plastic skylight panels from the roof of the structure in which the skylight panels are installed. These glazing systems typically include various fasteners and sealing systems which are accessed from the roof of the structure, in order to replace damaged glass or plastic skylight panels or to perform routine maintenance on the glazing system structural elements. A primary problem which is frequently realized in conventional structural glazing systems is that of seating and sealing the panels within the structural members in such a manner as to prevent leakage of water and infiltration of dust and other undesirable elements through the system and yet facilitate efficient maintenance of the installation.

Sloped or overhead skylight glazing systems generally include multiple horizontal framing members interconnected with cooperating vertical framing members to form a structural framing grid or lattice which defines multiple glazed openings of selected size, into openings glass or plastic panels are installed. The grid may be pitched or sloped at a selected angle with respect to the horizontal or it may be rounded, as in a greenhouse, and various forms of connecting and sealing components are employed to secure the panels within the glazing openings, to minimize infiltration of moisture, air and dust from the outside to the inside of the structure. Typical sealing components include resilient ceiling gaskets which grip the inner and outer panel surfaces, together with means for tightening these gaskets against these surfaces to create and air-tight connections. Calk is also sometimes used to facilitate such water, air and dust-tight connections.

2. Description of the Prior Art

Various structural glazing systems are known in the prior art for mounting glass skylight panels on sloped or overhead glazing systems, including greenhouses. Typical of these systems is the Modular Solar Greenhouse detailed in U.S. Pat. No. 4,462,390, dated July 31, 1984, to Holdridge, et al. The modular solar greenhouse detailed in this patent incorporates rigid, curving overhead frames provided with screw and nut tracks for ease of asembly and also uses companion east side and west side end modules for mounting a thermally broken glazing system. The exterior and interior portions of the aluminum frame extrusions are bonded together by a strong plastic material and at least one overhead heat storage unit is carried by the rigid frame. A "Ventilating Skylight" is detailed in U.S. Pat. No. 4,449,340, dated May 22, 1984, to Arthur P. Jentoft, et al. The skylight includes a domed or flat glazing which is adapted to fit within the opening of a roof having a peripheral frame which is fixed to the roof about the opening. The frame is characterized by a base frame and an operating leaf frame and a retainer is used to secure the skylight cover over the operating leaf frame. U.S. Pat. No. 4,621,472, dated Nov. 11, 1986, to Werner Kloke, details a "Glazed Structural System and Components Therefore". The patent discloses skylight structures wherein the supporting and supported structural members defining the metal framework, including flange formations upon which the glass panels are secured, are provided with longitudinally-extending drainage channel formations. The open ends of the drainage channel formations of the supported structural members intersect and overlap the drainage channel formations of the supporting structural members. Accordingly, water collected therein is discharged into the drainage channel formations of the supporting structural members at a point remote from the intersections thereof. The structural members at a point remote from the intersections thereof. The structural members are interconnected by displaceable clamping means carried by the overlapping ends, including a clip embracing the ends from below in the region of overlap and upon displacement, upwardly engage the flange formations of the supporting structural members from below. A "Rafter with Internal Drainage Feature and Sloping Glazing System Incorporating Same" is detailed in U.S. Pat. No. 4,680,905, dated July 21, 1987, to James A. Rockar. The patent details a sloped curtain wall or glazing system for a building, which system includes a plurality of rafters and purlins interconnected to provide at least one panel opening for retaining a panel. The rafters have an upwardly sloping vertical glazing pocket adapted to receive a vertical marginal edge portion of a panel and the purlins have a horizontal glazing pocket adapted to receive a horizontal marginal edge portion of a panel. The rafters further include a semi-enclosed drainage channel and a condensate gutter which are not disposed in fluid communication with either the drainage channel or the vertical glazing pocket. The purlins further include a condensation gutter and the purlin and rafter condensation gutters are disposed in fluid communication with each other. The drainage channel is provided with at least one opening to put the vertical and horizontal glazing pockets in communication therewith. The glazing system further includes a seal for separately collecting and discharging the infiltration moisture collected in the drainage system and the condensation moisture collected in the rafter condensation gutter. Copies of these patents are included with this patent application.

It is an object of this invention to provide new and improved sloped or curved structural glazing systems for skylights which effectively eliminate the need for conventional exterior fasteners, slots, sealing devices and holes commonly used for installing, maintaining and replacing glass and plastic skylight panels.

Another object of the invention is to provide a new and improved structural skylight glazing system which is characterized by a bottom closure carrier beam system wherein the skylight panels can be installed, maintained and replaced from inside a structure by detaching bottom-mounted closure members from the carrier beams and installing or removing multiple cap bolts from the carrier beams and companion exterior glazing caps, to secure and free the skylight panels, respectfully.

Another object of the invention is to provide new and improved structural glazing systems for skylight which include a side closure carrier beam system utilizing carrier beam closures which are side-mounted on selected carrier beams to facilitate installation, maintenance and removal of the glass or plastic skylight panels from inside a structure without traversing the roof.

A still further object of this invention is to provide structural glazing systems for skylights which include multiple, spaced carrier beams oriented in a lattice or grid configuration and fitted with glazing strips for receiving the bottom edges of adjacent glass or plastic skylight panels and multiple companion exterior glazing caps fitted with additional glazing strips for receiving and contacting the corresponding top edges of the adjacent panels for securing the panels between the glazing strips from inside the structure using cap bolts which extend upwardly through the carrier beams to threadibly engage the exterior glazing caps.

Still another object of the invention is to provide structural glazing systems for sloped and curved skylights in structures such as solaria, greenhouses, barrel vaults and like structures, which systems include multiple carrier beams mounted in spaced and intersecting relationship in the structure, the carrier beams each having an open chamber, an intersecting system of condensate gutters and a pair of bottom glazing strips attached to flat shoulders in the carrier beams, for receiving the bottom edges of glass or plastic skylight panels, and further including cooperating exterior glazing caps for mounting on companion carrier beams, respectively, the exterior glazing caps characterized by top glazing strips for engaging the top corresponding edges of the skylight panels and securing the panels in position in the structure by means of cap bolts inserted through the carrier beams from inside the open chamber and threadibly engaging the exterior glazing caps.

SUMMARY OF THE INVENTION

These and other objects of the invention are provided in structural glazing systems for skylights which include both bottom and side carrier beam closure systems, each of which systems is characterized by multiple, open-chamber carrier beams arranged in interconnecting relationship in a building or structure to define a lattice or grid; a pair of bottom glazing strips provided on spaced shoulders formed in the carrier beams, for engaging the edges of the bottom surface of glass or plastic skylight panels to be installed in the system; multiple exterior glazing caps shaped and adapted to mount on the tops of the carrier beams, respectively, the exterior glazing caps provided with an additional pair of glazing strips for seating on the corresponding edges of the top surfaces of the glass panels; and spaced cap bolts extending into the open chamber and through openings provided in the carrier beams and threaded into a continuous screwboss provided in each of the exterior glazing caps, respectively, for mounting the glass or plastic skylight panels in a lattice or grid between the respective parallel and intersecting sets of exterior glazing caps and carrier beams. In a most preferred embodiment of the invention, the carrier beams are fitted with elongated, removable closure strips that close the internal chambers in the carrier beams and conceal the cap bolt heads.

BRIEF DESCRIPTION OF THE DRAWINGS

The invention will be better understood by reference to the accompanying drawings, wherein.

DESCRIPTION OF THE PREFERRED EMBODIMENTS

Figure 1:
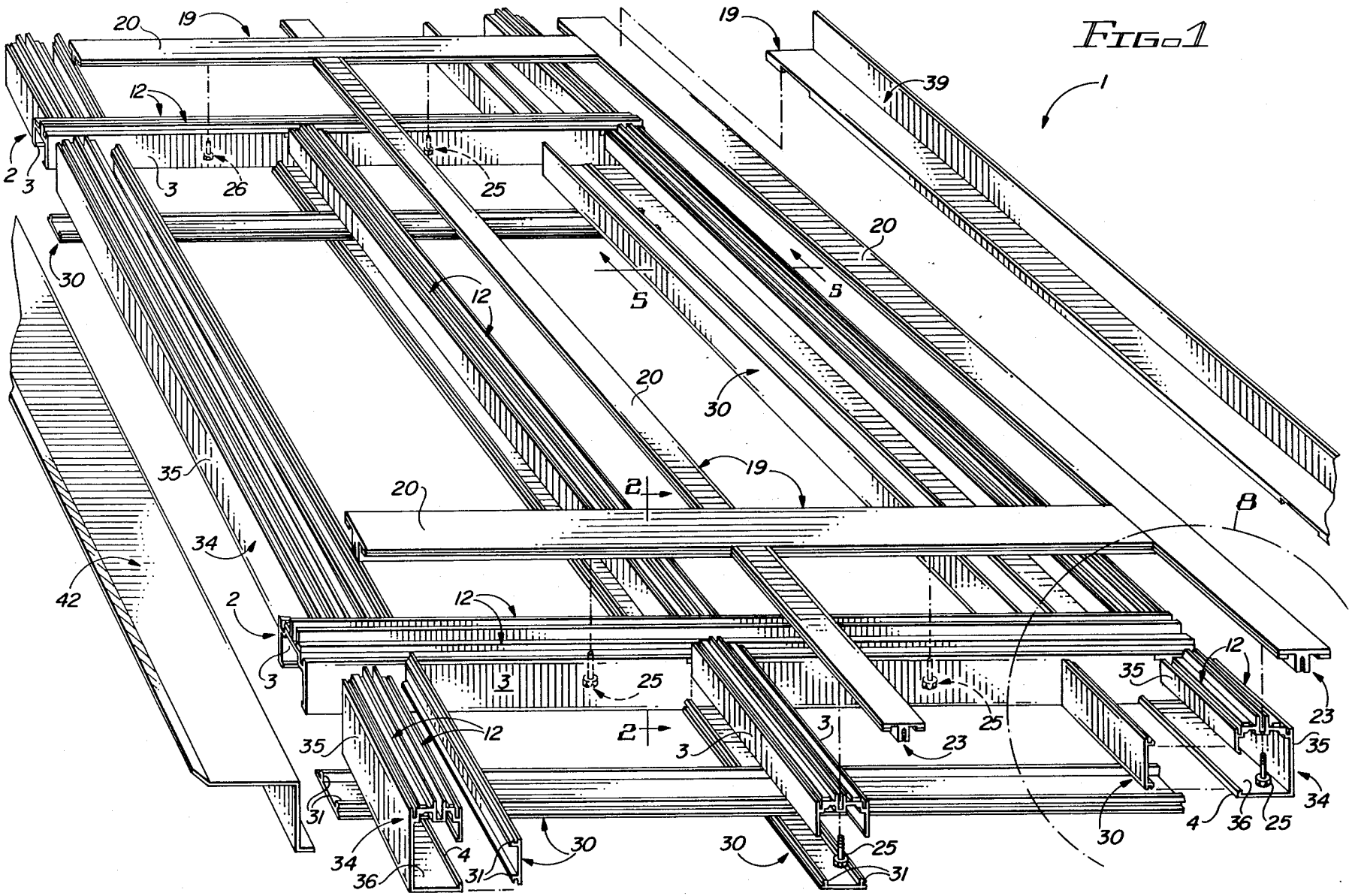
FIG. 1 is an exploded view, partially in section, of a preferred sloped structural glazing system for skilights of this invention.
Figure 7:
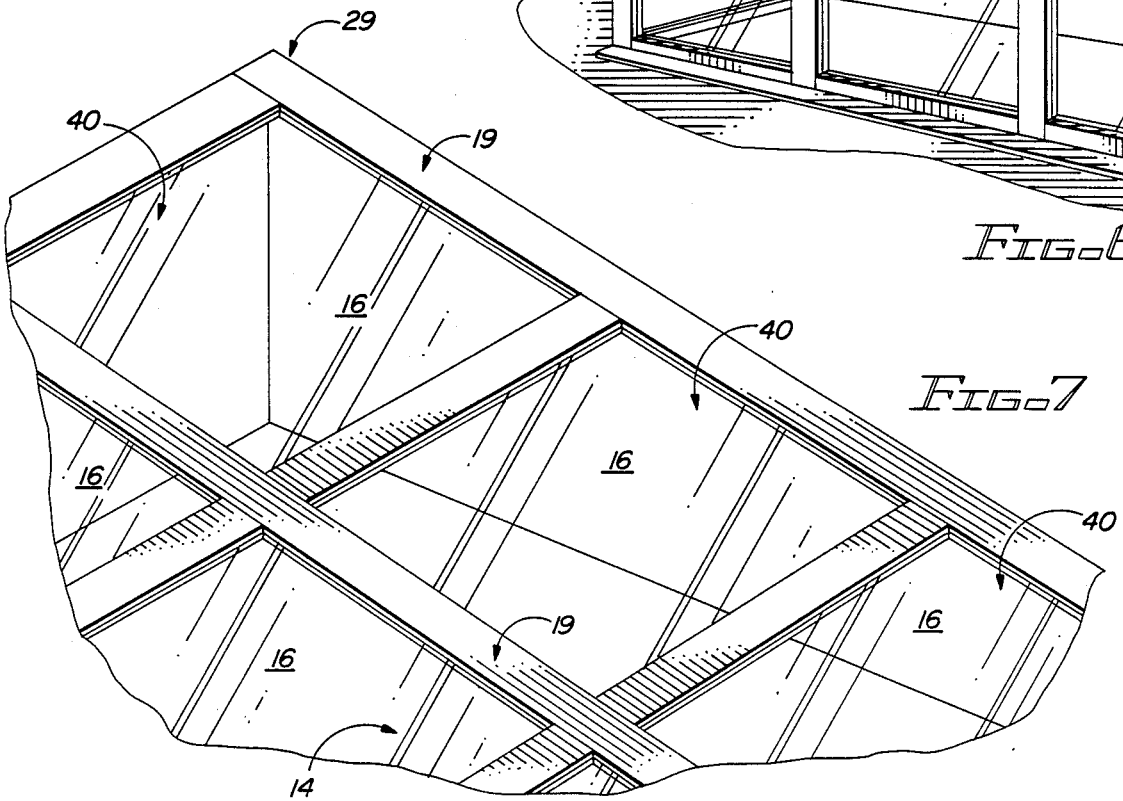
FIG. 7 is a top view of an installed sloped structural glazing system according to this invention.

Referring initially to FIGS. 1 and 7 of the drawings, a sloped structural embodiment of the structural glazing system of this invention is generally illustrated by reference numeral 1. The sloped structural glazing system 1 is illustrated as a sloped glazing system for purposes of illustration only and it will be appreciated that the structural components of the sloped structural glazing system 1 can be utilized in many other glazing systems, as hereinafter further described. The sloped structural glazing system 1 is characterized by a lattice or grid structure created by multiple, spaced and intersecting carrier beams 2 and head and sill carrier beams 34, which criss-cross at a 90 degree angle in spaced relationship, in order to define openings therebetween. While the angle of intersection of the carrier beams 2 and the head and sill carrier beams 34 is illustrated as 90 degrees, it will be further appreciated that the carrier beams 2 and head and sill carrier beams 34 may be installed in the sloped structural glazing system 1 in any desired spatial orientation at any desired angle, according to the teachings of this invention. All head and sill carrier beams 34 which lie over or adjacent to a wall 40, or a head, sill or jamb (not illustrated) in a conventional roof structure 29, are characterized by a side-access or closure design, whereas those carrier beams 2 which extend across the roof of the conventional roof structure 29 and are spaced from the walls 40 and the head, sill or jamb, are characterized by a bottom access or closure design, as hereinafter further described. Each of the carrier beams 2 and head and sill carrier beams 34 cooperate with a corresponding exterior glazing cap 19, which fits over the top of a corresponding carrier beam 2 and head and sill carrier beam 34 and secures the glass or plastic panels 16 between parallel carrier glazing strips 12, mounted on the carrier beams 2 and the head and sill carrier beams 34 and cooperating parallel cap glazing strips 22, mounted on the exterior glazing caps 19, respectively. Multiple cap bolts 25 project through openings provided in the carrier beams 2 and threadibly engage the exterior glazing caps 19 to secure the glass or plastic panels 16 between the carrier glazing strips 12 and the cap glazing strips 22, respectively, as hereinafter further described. An elongated carrier beam closure 30 removably seats in the bottom of each of the carrier beams 2 and in the sides of the head and sill carrier beams 34, respectively, to close the open chambers in the carrier beams 2 and the head and sill carrier beams 34, conceal the cap bolts 25 and provide asthetically pleasing bottom and side surfaces of the sloped structural glazing system 1 inside the host structure.

Figure 2:
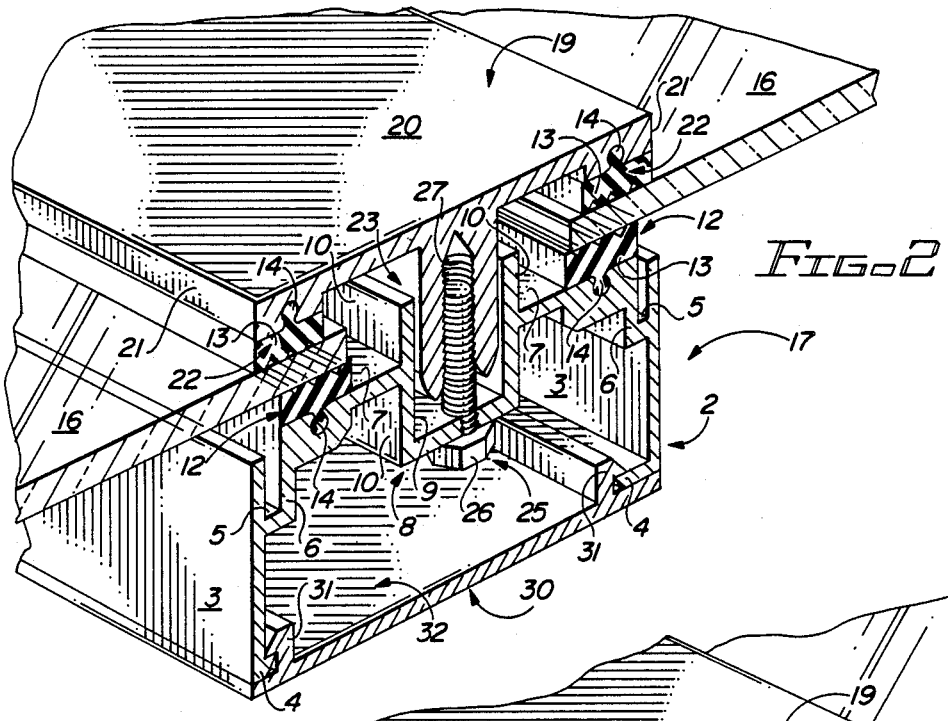
FIG. 2 is a sectional view taken along line 2—2 of the sloped structural glazing system illustrated in FIG. 1, more particularly illustrating an assembled bottom closure carrier beam embodiment of the sloped structural glazing system.
Figure 3:
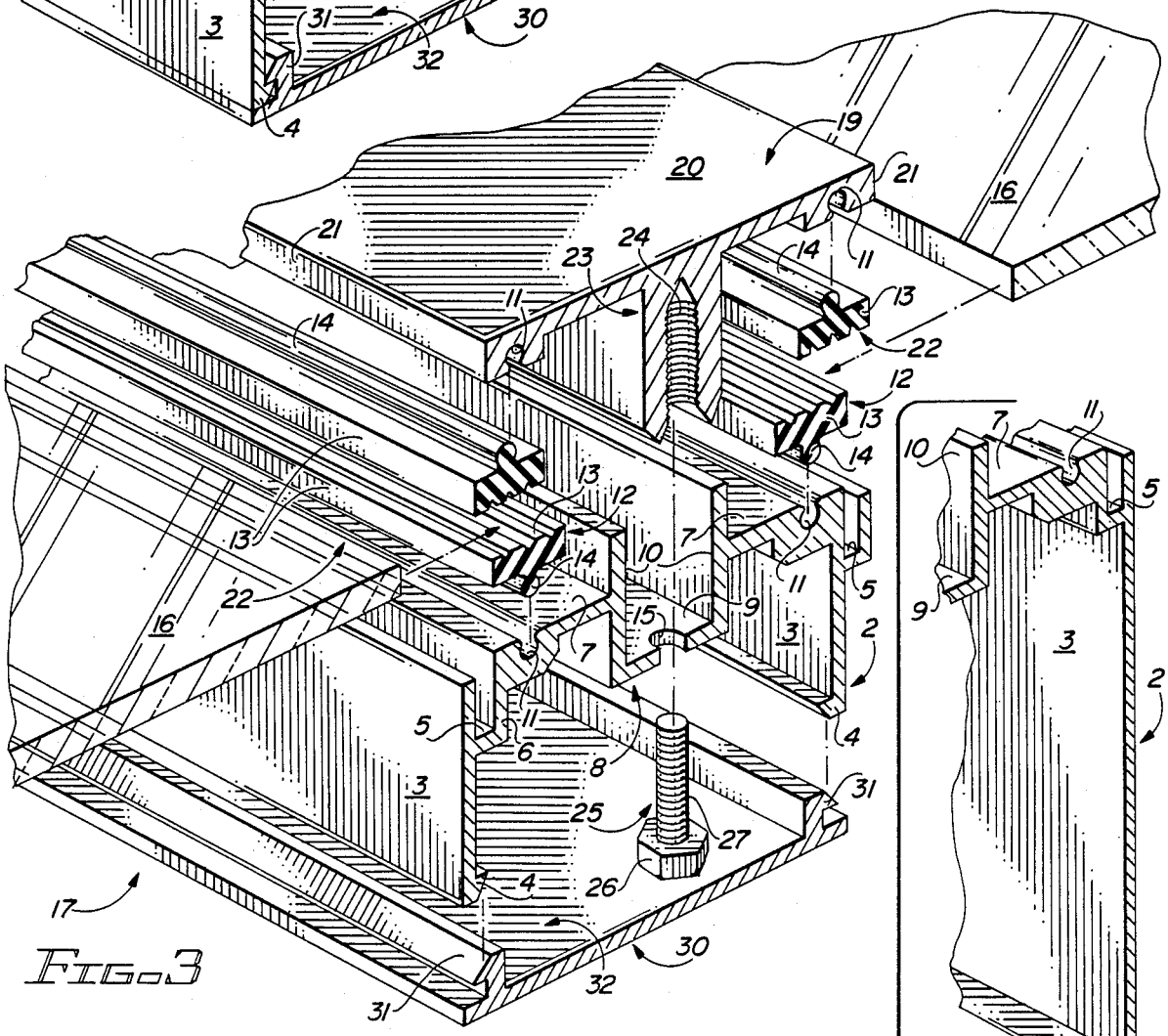
FIG. 3 is an exploded view of the assembled bottom closure carrier beam embodiment illustrated in FIG. 2.
Figure 4:
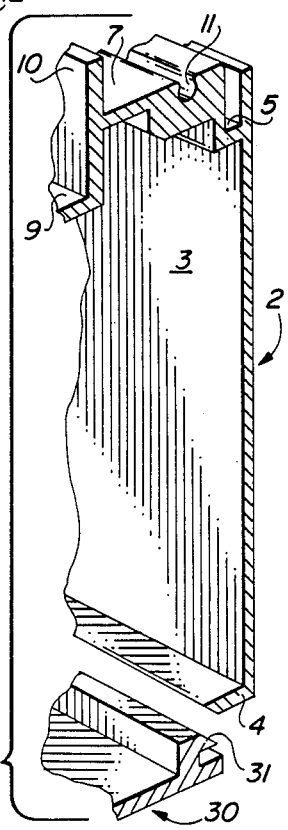
FIG. 4 is a sectional, enlarged view of one side of a carrier beam and carrier beam closure element of the bottom closure carrier beam embodiment illustrated in FIGS. 2 and 3.

Referring now to FIGS. 2–4 of the drawings, the bottom closure or access embodiment of the sloped structural glazing system 1 is more particularly illustrated. The carrier beam 2 utilized in the bottom closure design includes a pair of parallel carrier beam sides 3, each of which terminates at the bottom in oppositely-disposed, spaced side flanges 4, for receiving the flange connectors 31 of a cooperating carrier beam closure 30, to close the chamber 32, as illustrated. A pair of primary condensate gutters 5 are defined in parallel relationship on each side of the carrier beam 2 by the top segments of the upward-standing carrier beam sides 3 and corresponding, parallel gutter extensions 6, respectfully. The gutter extensions 6 extend upwardly to further define a pair of flat carrier beam shoulders 7, which are fitted with spaced, parallel anchor slots 11, as illustrated in FIG. 3. The carrier beam shoulders 7 terminate in a pair of upward-standing cap receiver sides 10, which, together with a connectig cap receiver base 9, define a central channel or cap receiver 8, wherein the cap receiver base 9 extends the entire length of each of the carrier beams 2 and runs parallel to and inwardly of the primary condensate gutters 5. Multiple base openings 15 are drilled or otherwise provided in spaced relationship in the cap receiver base 9 of the cap receiver 8 and the threaded shanks 27 of multiple cap bolts 25 are designed to extend through the base openings 15, to locate the bolt head 26 of each cap bolt 25 against the cap receiver base 9, as hereinafter further described. The top plate 20 of each exterior glazing cap 19 is fitted with a pair of parallel top plate flanges 21 on the outer edges thereof and a pair of parallel anchor slots 11 are provided in the top plate flanges 21, respectively, as further illustrated in FIG. 3. A continuous screwboss 23 projects downwardly from the center of the top plate 20 of the exterior glazing cap 19 between the top plate flanges 21 and screwboss threads 24 may be provided as an option in the continuous screwboss 23 at spaced points which correspond to each of the base openings 15 located in the cap receiver base 9 of the cap receiver 8. Alternatively, under circumstances where the continuous screwboss 23 is extruded from or otherwise fabricated of a soft metal such as aluminum, the threaded shank 27 of each cap bolt 27 threads its way into the continuous screwboss 23 at spaced intervals when installed by a driving tool. Accordingly, the continuous screwboss 23 is designed to register with and seat inside the cap receiver 8, as the threaded shank 27 each of the cap bolts 25 extends through a companion base opening 15 in the cap receiver base 9 and threadibly engages the screwboss threads 24 or the soft metal parallel flanges in the continuous screwboss 23, to secure each exterior glazing cap 19 to the top edge of a corresponding carrier beam 2. Referring again to FIGS. 2 and 3 of the drawings, a pair of resilient, sealing carrier glazing strips 12 are fitted on the carrier beam shoulders 7 of each carrier beam 2 by inserting the projecting glazing strip anchors 14 in the respective corresponding anchor slots 11. Similarly, the cap glazing strips 22 are fitted on the parallel top plate flanges 21 of each exterior glazing cap 19, by inserting the corresponding glazing strips anchors 14 into the corresponding anchor slots 11, respectively. Alternatively, under circumstances where the carrier glazing strips 12 and cap glazing strips 22 are not provided with companion glazing strip anchors 14, the carrier glazing strips 12 and cap glazing strips 22 may be glued into the positions noted above, according to the knowledge of those skilled in the art. Accordingly, the section of glass or plastic panel 16 can be inserted between the glazing strip body 13 of each of the carrier glazing strips 12 and the corresponding cap glazing strips 22 and the spaced cap bolts 25 are then tightened to secure the glass or plastic panels 16 in place, as illustrated in FIG. 2. After this installation step is completed, the respective carrier beam closures 30 may be installed on the bottom edges of the corresponding carrier beam sides 3 to cover and conceal the cap bolts 25, by matching the side flanges 4 with the flange connectors 31, as further illustrated in FIG. 2.

Figure 5:
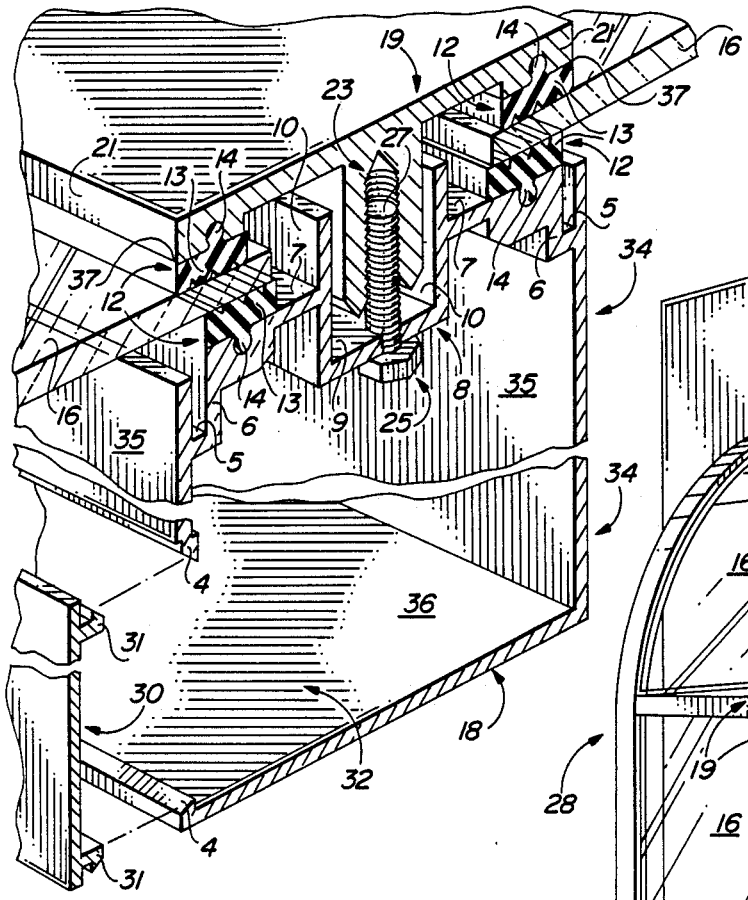
FIG. 5 is a sectional view taken along line 5—5 of the sloped structural glazing system illustrated in FIG. 1, more particularly illustrating an assembled side closure carrier beam embodiment of the sloped structural glazing system.

Referring now to FIGS. 5 and 7 of the drawings, the side closure or access embodiment of the structural glazing system 1 is more particularly detailed. In the side closure design, the head and sill carrier beam 34 is constructed parallel to and above the wall 40 and the head and sill carrier beam base 36 extends from one of the head and sill carrier beam sides 35. A space is provided between the respective side flanges 4 and the opposite, shorter head and sill carrier beam side 35, in order to accommodate a side-mounted carrier beam closure 30, which removably seats in the shorter one of the head and sill carrier beam sides 35 by means of cooperating oppositely-disposed flange connectors 31 and the corresponding side flanges 4, as illustrated. The location of this space facilitates access to the chamber 32 provided in each of the head and sill carrier beams 34, to install and remove the cap bolts 25, since the head and sill carrier beam base 36 is normally resting on or in close proximity to the wall 40 or an extension of the wall 40, or above a head, sill or jamb (not illustrated) in the structure, and bottom access to the chamber 32 is therefore prevented. As in the case of the carrier beam 2 illustrated in FIGS. 2 and 3, the head and sill carrier beam 34 is provided with a pair of parallel primary condensate gutters 5, the walls of which extend upwardly to define a pair of spaced, flat carrier beam shoulders 7, that receive additional parallel, resilient, sealing carrier glazing strips 12. A downwardly-extending cap receiver 8 is located between the carrier beam shoulders 7 and receives the multiple cap bolts 25 through the base openings 15, in order to threadibly secure the continuous screwboss 23 of a corresponding exterior glazing cap 19 in the cap receiver 8, and the top plate 20, fitted with cap glazing strips 22, on the head and sill carrier beam 34. Further as in the case of the carrier beam 2, a pair of glass or plastic panels 16 are sandwiched between corresponding parallel pairs of the respective carrier glazing strips 12 and cap glazing strips 22 and are mounted and sealed in this position by tightening the spaced cap bolts 25 from inside each chamber 32.

Figure 8:
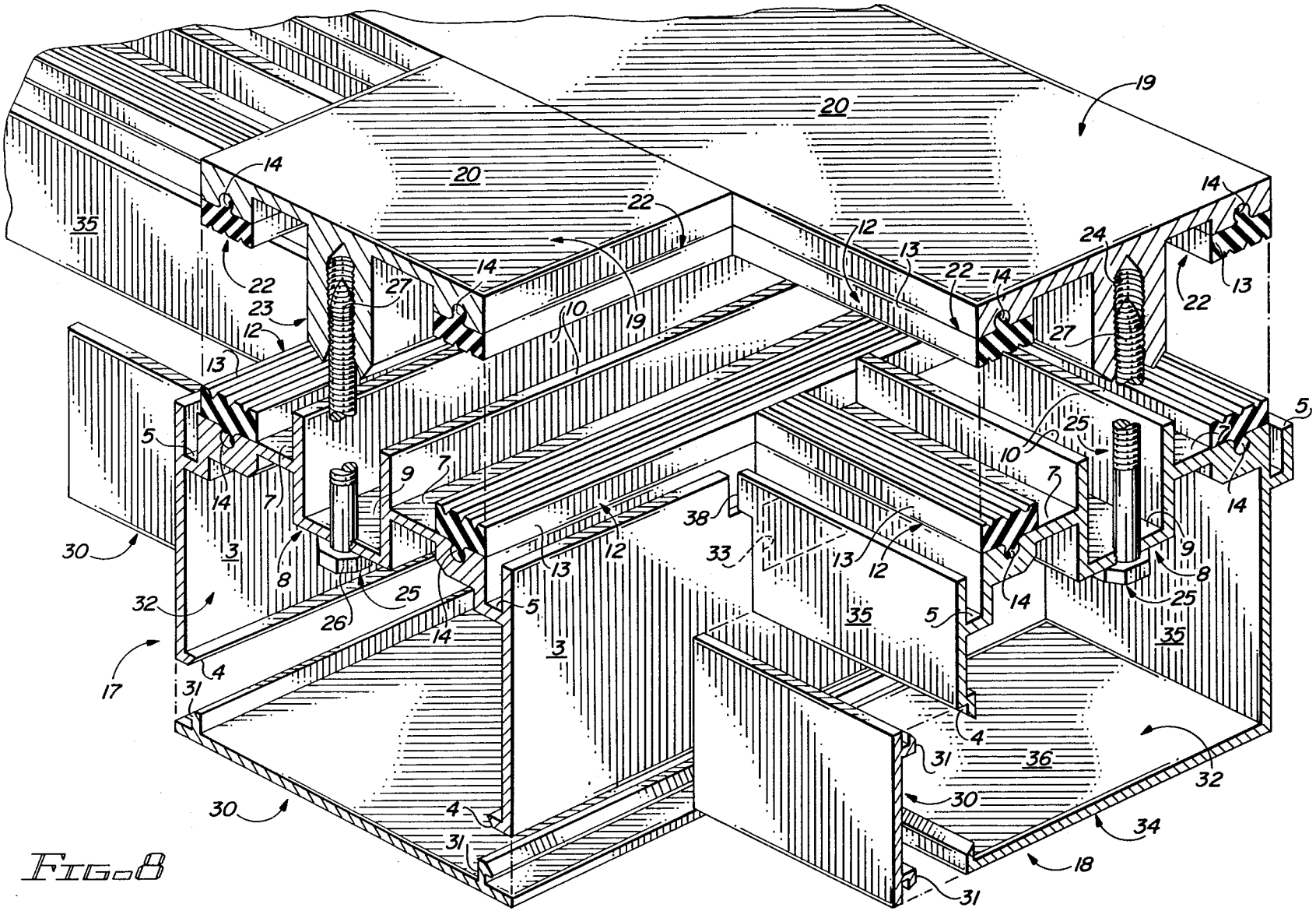
FIG. 8 is a sectional view taken along line 8—8 of the sloped structural glazing system illustrated in FIG. 1, more particularly illustrating an assembled intersection between the bottom closure carrier beam and side closure carrier beam embodiments of the structural glazing system of this invention.

Referring again to FIGS. 1 and 8 of the drawings, it will be appreciated that the bottom closure and side closure designs of the sloped structural glazing system 1 are designed to facilitate mounting one or more glass or plastic panels 16 in a lattice or grid which is characterized by joints, intersections or connecting points between respective head and sill carrier beams 34. Accordingly, the carrier beams 2 are joined to the head and sill carrier beams 34 as illustrated in FIG. 8. In these intersectional connections, it should be remembered that the bottom closure carrier beams 2 are constructed as illustrated in FIGS. 2–4, while the side closure head and sill carrier beams 34 are constructed as illustrated in FIG. 5, as heretofore described. The intersection of these structural components as detailed in FIG. 8 is further illustrated in exploded configuration in FIG. 1. In a most preferred embodiment of the invention, the respective top plates 20 of the exterior glazing caps 19 which correspond to the subject carrier beams 2 are cut and shaped to butt against the sides of the companion top plates 20 which correspond to the corresponding head and sill carrier beams 34, as illustrated in FIGS. 1 and 8. Furthermore, the respective primary condensate gutters 5 meet at the gutter corners 38 and are mitered at that point, to more efficiently carry condensate away from the glass or plastic panels 16. Additionally, a connector plate 33 may be welded or otherwise attached to the carrier beam sides 3 and the head and sill carrier beam sides 35, as illustrated, in order to stiffen the intersections between the respective carrier beams 2 and the head and sill carrier beams 34. It will be appreciated that the intersections between respective carrier beams 2 are constructed in like manner, as illustrated in FIG. 1.

Figure 6:
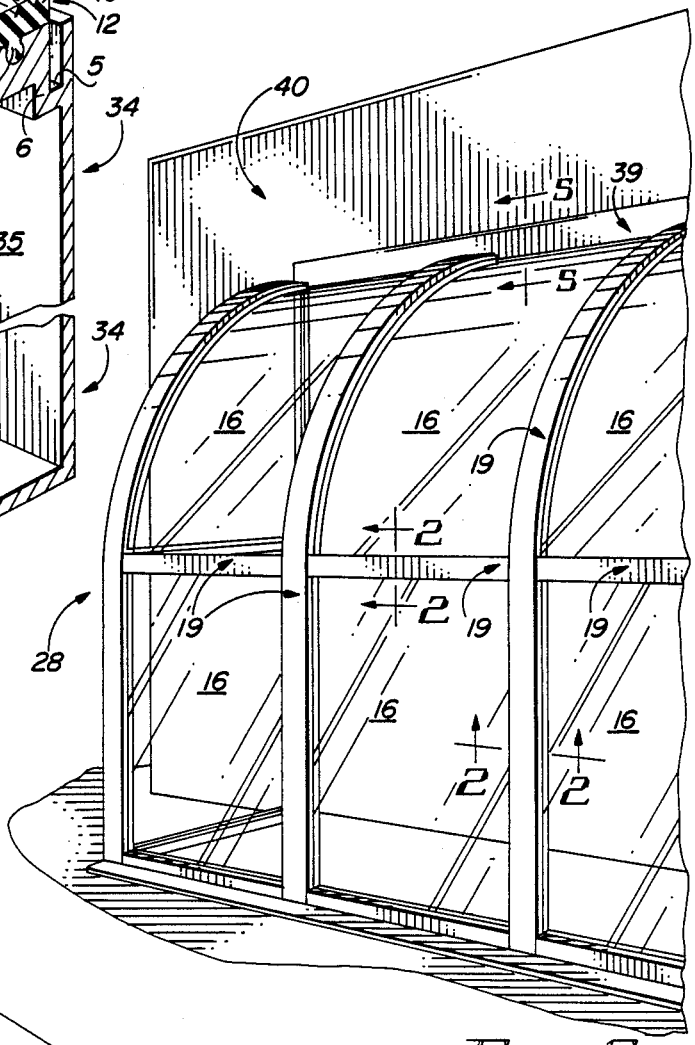
FIG. 6 is a perspective view, partially in section, of a typical curved roof or greenhouse structural glazing system of this invention.

Referring again to FIG. 6 of the drawings, it will be appreciated that the structural elements of the sloped structural glazing system 1 can be utilized to create a curved roof structure, as in the case of the greenhouse structure 28, as well as in the sloped system as illustrated in FIGS. 1 and 7. Under these circumstances, a head and sill carrier beam 34 may be utilized at the top of the greenhouse structure 28, in combination with a strip of head flashing 39, as further illustrated in FIG. 1. Furthermore, a strip of sill and jamb flashing 42, also illustrated in FIG. 1, can also be used under circumstances where a window or door is to be provided adjacent to the glass or plastic panels 16. The cross-sections illustrated in FIGS. 2–4 and 5 are also illustrated in FIG. 6 to indicate like configurations of the carrier beams 2 and head and sill carrier beams 34.

Referring again to FIG. 5 of the drawings, in a most preferred embodiment of the invention a caulk notch or margin 37 is provided in the top plate flanges 21 shaped in the top plate 20 of each of the exterior glazing caps 19. This caulk margin 37 is used to receive an optional bead of caulk material along the edges of the carrier glazing strips 12, in order to provide additional security in sealing the respective glass or plastic panels 16, particularly under circumstances where thermal expansion of the structure may tend to cause the carrier glazing strips 12 to move.

It will be appreciated by those skilled in the art that the various structural components of the structural glazing systems of this invention are preferably extruded from a soft, light metal such as aluminum. However, certain components in specific applications not requiring large glass or plastic panels or characterized by minumum load-bearing requirements, may be injection-molded or extruded of plastic materials, according to the knowledge of those skilled in the art. Furthermore, the structural glazing systems may be used to mount skylight panels of any desired size, shape, thickness and composition, with the appropriate adjustment for panel thickness effected by using cap bolts 25 having a threaded shank 27 of suitable length. Panels which may be mounted and maintained according to the structural glazing systems of this invention are typically constructed of glass and plastic, such as "Plexiglass" and other transparent materials, in non-exclusive particular.

While the preferred embodiments of the invention have been described above, it will be recognized and understood that various modifications may be made therein and appended claims are intended to cover all such modifications which may fall within the spirit and scope of the invention.

Having described my invention with the particularity set forth above, what is claimed is:

1. A structural glazing system for mounting at least one skylight panel in the structure comprising a plurality of carrier beams arranged in interconnecting relationship to define a plurality of intersections and a grid having at least one opening for receiving the panel, each of said carrier beams having a pair of spaced shoulders portions, a pair of primary condensate gutters terminating the edges of said shoulder portions in spaced relationship, said primary condensate gutters extending substantially along the entire length of said carrier beams and joining at said intersections, respectively, said carrier beams each having an open chamber extending substantially along the entire length thereof, and further comprising a plurality of carrier beam closures arranged substantially in alignment with said open chamber in interconnecting relationship and adopted to removably engage said carrier beams and close said open chamber, respectively; a pair of side flanges provided on each of said carrier beams and a pair of flange connectors provided on each of said carrier beam closures, said flange connectors adapted to removably engage said side flanges and removably secure said carrier beam closures to said carrier beams, respectively; a first pair of resilient sealing strips provided on said shoulder portions, said first pair of resilient sealing strips extending substantially along the length of the corresponding edge of the skylight panel, respectively; and an outwardly-extending, channel-shaped cap receiver disposed between said shoulder portions and spaced openings provided in said cap receiver; a plurality of exterior glazing caps arranged in interconnecting relationship and adapted to mount on the top of said carrier beams, respectively, each of said exterior glazing caps characterized by a top plate and a second pair of resilient sealing strips engaging the bottom surface of said top plate in spaced relationship, said second pair of resilient sealing strips extending substantially along the length of said corresponding edge of the skylight panel, substantially in alignment with said first pair of resilient sealing strips, respectively; a downwardly-extending screwboss carried by said top plate between said second pair of sealing means in each of said exterior glazing caps, respectively, said screwboss adapted for registration with said cap receiver, respectively; and a plurality of bolts of selected length extending upwardly through said spaced openings in said cap receiver, said bolts engaging said screwboss, whereby corresponding edges of the skylight panel are secured between aligned pairs of said first pair of resilient sealing strips and said second pair of resilient sealing strips, respectively, responsive to tightening said bolts, and said screwboss is secured inside said cap receiver.

2. The structural glazing system of claim 1 further comprising first anchor slots provided in each of said shoulder portions and first anchor strips extending from said first pair of resilient sealing strips, respectfully, said first anchor strips engaging said first anchor slots; and second anchor slots provided in spaced relationship in said top plate and second anchor strips extending from said second pair resilient sealing strips, respectively, said second anchor strips engaging said second anchor slots, whereby said first pair of resilient sealing strips are removably secured to said shoulder portions of said carrier beams, respectively, and said second pair of resilient sealing strips are removably secured to said top plate, respectively.

3. The structural glazing system of claim 2 wherein said open chamber opens at the bottom of selected ones of said carrier beams, respectively.

4. The structural glazing system of claim 2 wherein said open chamber opens on one side of selected ones of said carrier beams, respectively.

5. The structural glazing system of claim 2 wherein said open chamber opens at the bottom of first selected ones of said carrier beams, respectively, and said open chamber opens on one side of second selected ones of said carrier beams, respectively.

6. A structural glazing system for mounting a plurality of skylight panels in a structure, comprising a first plurality of carrier beams provided in spaced relationship in the structure and a second plurality of carrier beams arranged in said structure in spaced, interconnecting relationship with respect to said first plurality of carrier beams to define a plurality of intersections and a grid having a plurality of openings for receiving the panels, respectively, each of said carrier beams having an open chamber and a pair of spaced shoulder portions a pair of primary condensate gutters terminating said shoulder portions, respectively, said primary condensate gutters extending substantially along the entire length of said carrier beams and joining at said intersections, respectively; a first pair of sealing means provided on said shoulder portions, said first pair of sealing means extending substantially along the length of corresponding edges of the skylight panels, respectively, an upwardly-extending, channel-shaped cap receiver disposed between said shoulder portions and spaced openings provided in said cap receiver means; a plurality of exterior glazing caps arranged in interconnecting relationship and adapted to mount on the top of said carrier beams, respectively, each of said exterior glazing caps characterized by a top plate and a second pair of sealing means engaging the botom surface of said top plate in spaced relationship, said second pair of sealing means extending substantially along the length of said corresponding edges of the skylight panels substantially in alignment with said first pair of sealing means, respectively; a downwardly-extending screwboss carried by said top plate between said second pair of sealing means in each of said exterior glazing caps, respectively, said screwboss adapted for registration with said cap receiver, respectively; and threaded fastening means extending upwardly through said spaced openings in said cap receiver means and threadibly engaging said screwboss means, whereby said corresponding edges of the panels are secured between aligned pairs of said first pair of sealing means and said second pair of sealing means, respectively, responsive to tightening said threaded fastening means and said screwboss is secured inside said cap receiver.

7. The structural glazing system of claim 6 further comprising:

(a) a plurality of carrier beam closures arranged substantially in alignment with said open chamber in interconnecting relationship and adapted to engage said carrier beams and close said open chamber, respectively; and (b) a pair of side flanges provided on each of said carrier beams and a pair of flanged connectors provided on each of said carrier beam closures, said flange connectors adapted to removably engage said side flanges and removably secure said carrier beam closures to said carrier beams, respectively.

8. The structural glazing system of claim 7 wherein:

(a) said threaded fastening means are bolts; and (b) said first pair of sealing means and said second pair of sealing means each further comprises a first pair of resilient sealing strips and a second pair of resilient sealing strips.

9. The structural glazing system of claim 8 wherein said open chamber opens at the bottom of first selected ones of said carrier beams, respectively, and said open chamber opens on one side of second selected ones of said carrier beams, respectively.

10. The structural glazing system of claim 9 further comprising first anchor slots provided in each of said shoulder portions and first anchor strips extending from said first pair of resilient sealing strips, respectfully, said first anchor strips engaging said first anchor slots; and second anchor slots provided in spaced relationship in said top plate and second anchor strips extending from said second pair of resilient sealing strips, respectively, said second anchor strips engaging said second anchor slots, whereby said first pair of resilient sealing strips are removably secured to said shoulder portions of said carrier beams, respectively, and said second pair of resilient sealing strips are removably secured to said top plates of said exterior glazing caps, respectively.

* * * * *